US005339639A

United States Patent [19]

Garrett

[11] Patent Number: 5,339,639

[45] Date of Patent: Aug. 23, 1994

[54] FREON FREE REFRIGERATOR

[75] Inventor: Michael E. Garrett, Woking, England

[73] Assignee: The BOC Group Plc., Windlesham, England

[21] Appl. No.: 908,661

[22] Filed: Jul. 2, 1992

[30] Foreign Application Priority Data

Jul. 13, 1991 [GB] United Kingdom ..... 9115140.7

[51] Int. Cl.[5] ..... F25B 9/00

[52] U.S. Cl. ..... 62/6; 62/112; 62/480

[58] Field of Search ..... 62/6, 467, 480, 112; 165/104.12; 95/106

[56] References Cited

U.S. PATENT DOCUMENTS

| | | | |
|---|---|---|---|
| 3,262,277 | 7/1966 | Nesbitt | 62/6 |
| 3,817,044 | 6/1974 | Daniels | 62/6 |
| 4,183,734 | 1/1980 | Leppard | 95/105 |
| 4,413,670 | 11/1983 | Ritter | 165/1 |
| 4,489,533 | 12/1984 | Wheatley | 53/228 |
| 4,584,840 | 4/1986 | Baumann | 62/6 |

FOREIGN PATENT DOCUMENTS 1078107 8/1967 United Kingdom .

*Primary Examiner*—William E. Wayner

*Attorney, Agent, or Firm*—David A. Draegert; Larry R. Cassett

[57] ABSTRACT

A refrigerator includes a cylinder containing a bed of adsorbent material and a gas, e.g. carbon dioxide. A piston compresses the gas which is adsorbed by the adsorbent material and the heat of adsorption is dissipated by fins to atmosphere. The piston, when retracted, decompresses the gas which desorbs from the adsorbent material. Repeated compression and decompression of the gas causes a cold zone to be created within the material which is thermally linked to a location to be refrigerated.

11 Claims, 3 Drawing Sheets

FREON FREE REFRIGERATOR

TECHNICAL FIELD

The present invention relates to refrigerators.

BACKGROUND OF THE PRIOR ART

Refrigeration at about ambient temperature is currently achieved by using the compression cycle with halogenated hydrocarbons such as freon (Registered Trademark) gas as the refrigerating medium. Freon gas is compressed and the heat of compression i s conducted to atmosphere thereby causing the gas to condense to a liquid. The liquid freon is then passed to the inside of an insulating chamber where it is allowed to expand and evaporate thereby cooling the chamber. The expanded freon gas then returns to a compressor for the cycle to be repeated.

Problems appear to arise when these known refrigerators wear out since, when they are re-cycled or scrapped, it is believed that the freon type gases are released thereby damaging the ionosphere.

An alternative cycle is available in domestic refrigeration and is known as the ammonia adsorption cycle. However, it is less efficient and often less reliable being dependent on the containment of hydrogen gas.

SUMMARY OF THE INVENTION

It is an aim of the present invention to provide a refrigerator which utilizes the cold zone(s) which are created when certain gases are adsorbed by and then desorbed from a bed of adsorbent material.

According to one aspect of the present invention, a refrigerator comprises a chamber containing a bed of an adsorbent material and a compressible gas capable of being adsorbed under pressure by said adsorbent material and desorbed from said adsorbent material when said pressure is released, means for alternately compressing and decompressing the gas within the chamber thus creating a cold zone within the chamber, and means for thermally connecting the cold zone to a location to be refrigerated.

According to a further aspect of the present invention, a method of refrigeration comprises the steps of:

a) compressing a gas within a chamber containing a bed of an adsorbent material such that some at least of the gas is adsorbed by said adsorbent material;

b) removing heat generated by the adsorption step;

c) decompressing the gas within the chamber such that the gas is desorbed from the adsorbent material thereby creating a cold zone; and d) thermally connecting said cold zone to a location to be refrigerated.

BRIEF DESCRIPTON OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
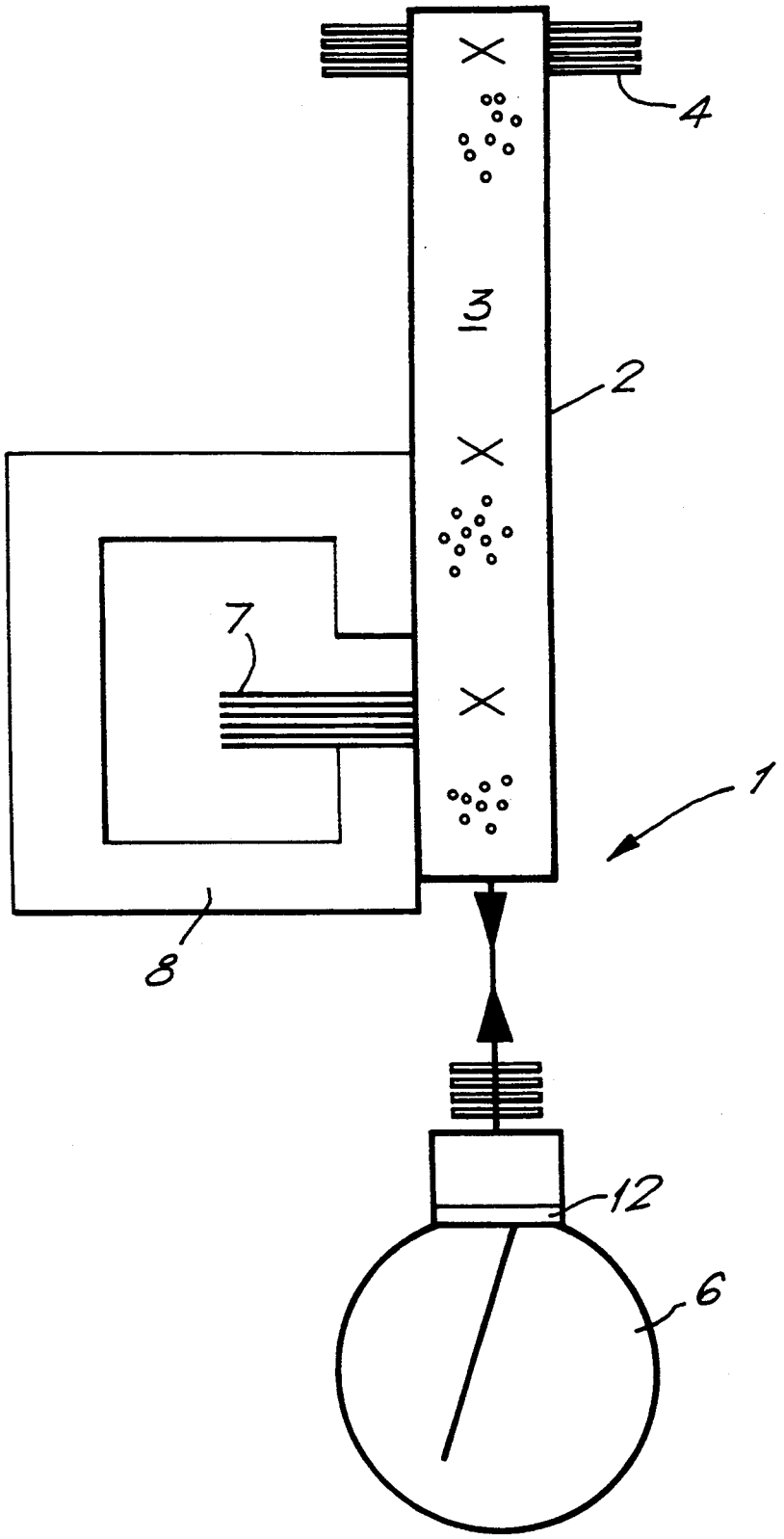
FIG. 1 is a schematic view of one embodiment of a refrigerator according to the present invention.

As shown in FIG. 1, a refrigerator 1 includes a chamber in the form of a hollow cylinder 2 within which is located a bed of an adsorbent material 3, for example, a zeolite having a high heat adsorption such as 13X or 5A type. Also located within the cylinder 2 is a pre-selected volume of a gaseous medium such as carbon dioxide which has a high affinity for the adsorbent material 3 and is readily compressible.

Figure 2:
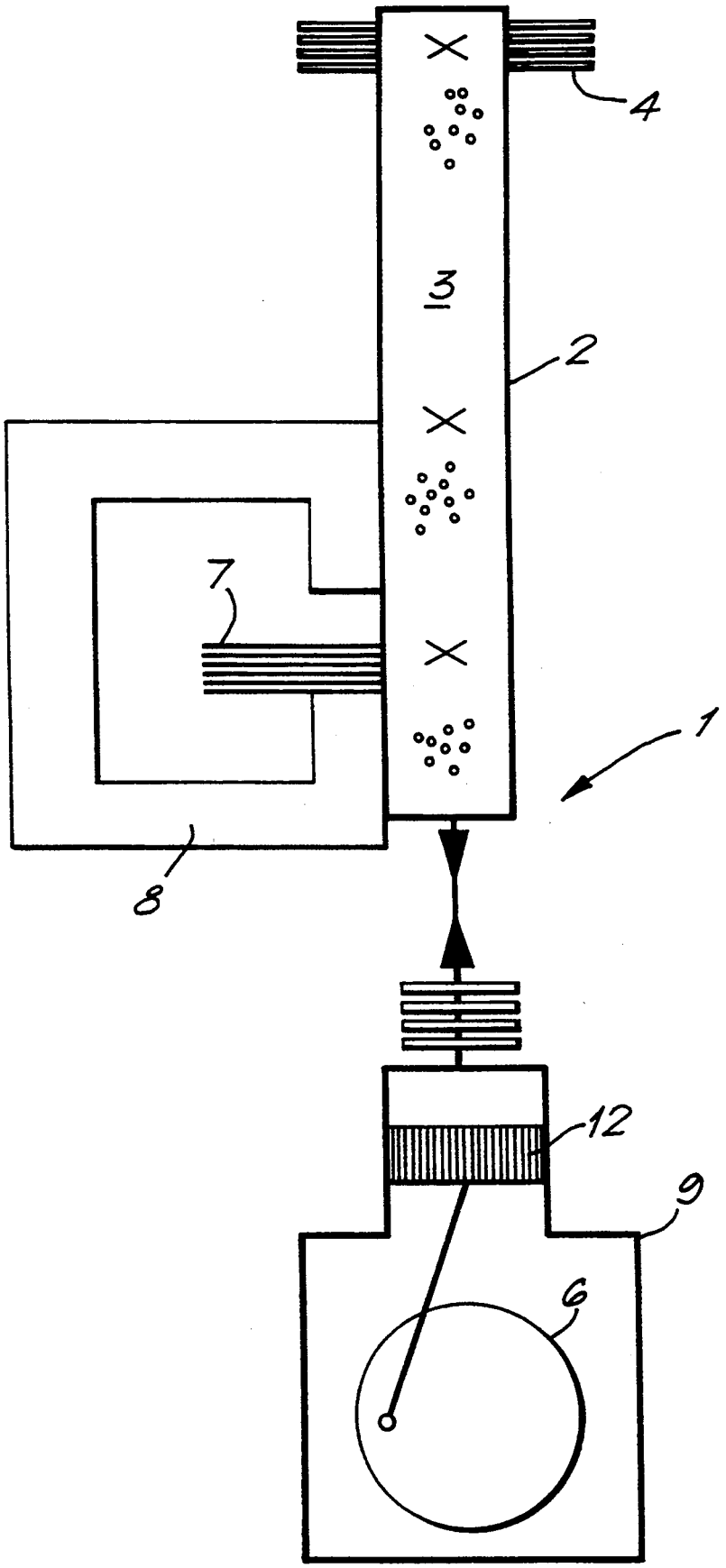
FIG. 2 is a second embodiment of the refrigerator according to the present invention with a housing sealing the compressor and piston.
Figure 3:
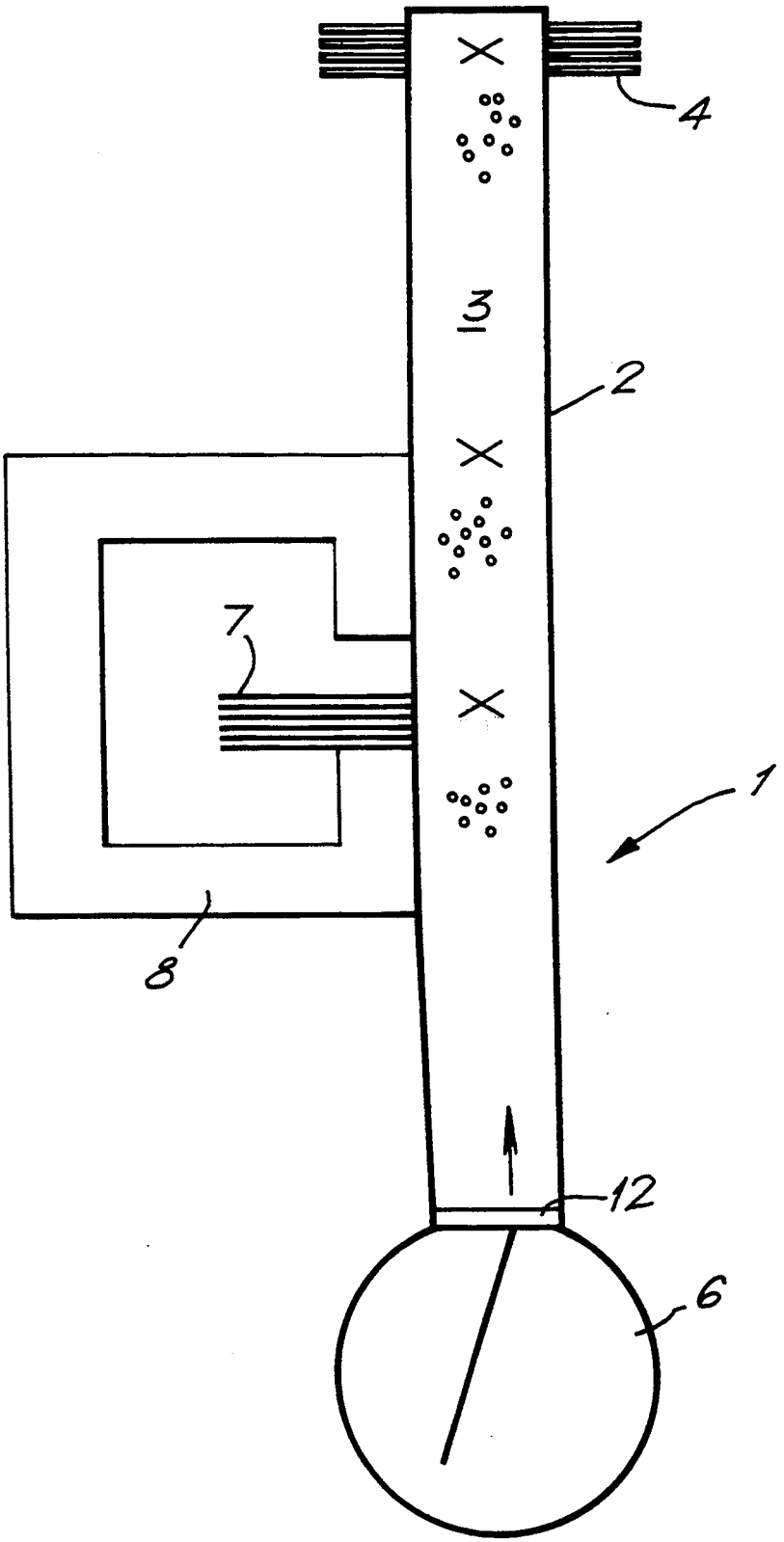
FIG. 3 is a schematic view of a third embodiment of the invention showing the piston slidably received within the cylinder.

As shown in FIG. 1, the cylinder 2 is arranged vertically and operatively connected to its lower end is a piston 12 extending from a compressor 6, preferably of the type totally sealed from the atmosphere (see FIG. 2). In an embodiment of the invention as particularly shown in FIG. 3, the piston 12 is slidable received within the cylinder 2. The piston 12 is adapted to seal the carbon dioxide within the cylinder 2 and, when reciprocated, alternately to compress and decompress the carbon dioxide.

Adjacent the lower end of the cylinder 2 there is located thermally connecting means in the form of plates 7 which extend from the outer surface of the cylinder 2 to enter the interior of a compartment B which interior is to be cooled.

At its upper (as shown) end attached to the cylinder 2 are a plurality of cooling fins 4.

In accordance with a preferred embodiment of the invention, the compressor 6 and piston associated therewith may be sealed within a housing 9 as shown specifically in FIG. 2.

In use as shown in FIG. 1, the compressor 6 is started and upwardly extends the piston 12 to thereby compress the carbon dioxide. The upward movement of the piston 12 may extend into the interior of the cylinder as shown specifically in FIG. 3. material 3 at the lower end of the zeolite bed thereby generating heat. The heat generated is carried upward by further incoming carbon dioxide with the result that when the compression stroke of the compressor is completed a heat spot is formed at the extreme upper end of the cylinder 2. This heat spot is dissipated by means of the cooling fins 4 to ambient atmosphere.

During downward retractive movement of the piston 12, the decompression of the carbon dioxide takes place which carbon dioxide is desorbed from the adsorbent material 3 leading to a net cooling of the adsorbent material 3. Because some of the heat has been dissipated by means of the cooling fins 4 some of the material 3 will become very cool and it has been found, over a number of cycles of the compressor, a cold spot is formed within the bed of adsorbent material 3 close to the lower end of the cylinder 2 (at the point of entry of the piston 12 in the embodiment shown in FIG. 3). This cold spot is thermally linked to the interior of the compartment 8 by plates 7 thereby allowing the interior of the compartment 8 to be refrigerated.

Particular advantages of the embodiment described above are (a) the materials employed are all environmentally friendly so that the ultimate disposal of the refrigerator presents no problems; and (b) the system is a closed system requiring no constant replacement of adsorbent or gas.

Although the invention has been described with reference to specific example, it will be appreciated by those skilled in the art that the invention may be embodied in any other form.

I claim:

1. A refrigerator comprising a chamber containing a bed of an adsorbent material and a compressible gas capable of being adsorbed under pressure by said adsorbent material and desorbed from said adsorbent material when said pressure is reduced, means for alternately compressing and decompressing the gas within the chamber thus creating a cold zone within the chamber and means for thermally connecting the cold zone to a compartment to be refrigerated, said thermally connecting means comprising a plurality of conductive plates located adjacent the chamber and in alignment with the cold zone and extending within the interior of the compartment to be refrigerated.

2. A refrigerator as claimed in claim 1, in which the adsorbent material is a zeolite and the compressible gas is carbon dioxide.

3. A refrigerator as claimed in claim 1, in which at the upper end of the cylinder cooling fins are attached to the cylinder.

4. A refrigerator as claimed in claim 1 wherein the means for alternately compressing and decompressing the gas comprises a piston movable by a compressor.

5. A refrigerator as claimed in claim 4 wherein the compressor and piston are contained in a sealed housing.

6. A method of refrigeration comprising the steps of:

a) compressing a gas within a chamber containing a bed of an adsorbent material such that at least some of the gas is adsorbed by said adsorbent material;

b) removing heat generated by the adsorption step;

c) decompressing the gas within the chamber such that the gas is desorbed from the adsorbent material thereby creating a cold zone; and d) thermally connecting said cold zone to a compartment to be refrigerated by means of a plurality of conductive plates located adjacent the chamber, said conductive plates being in alignment with the cold zone and extending within the interior of the compartment to be refrigerated.

7. A refrigerator comprising a chamber containing a bed of a zeolite and gaseous carbon dioxide capable of being adsorbed under pressure by said zeolite and desorbed from said zeolite when said pressure is reduced, means for alternately compressing and decompressing the gas within the chamber thus creating a cold zone within the chamber and means for thermally connecting the cold zone to a compartment to be refrigerated.

8. A refrigerator as claimed in claim 7 in which the thermally connecting means ia plurality of conductive plates located adjacent the chamber and in alignment with the cold zone and extending within the interior of the compartment to be refrigerated.

9. A refrigerator as claimed in claim 7 in which at the upper end of the chamber cooling fins are attached to the chamber.

10. A refrigerator as claimed in claim 7 wherein the means for alternately compressing and decompressing the gas comprises a piston movable by a compressor.

11. A refrigerator as claimed in claim 10 wherein the compressor and piston are contained in a sealed housing.

* * * * *